United States Patent [19]

Martin

[11] Patent Number: 4,517,425

[45] Date of Patent: May 14, 1985

[54] SELF-FLOW GENERATING GAS INTERRUPTER

[75] Inventor: Donald R. Martin, Racine, Wis.

[73] Assignee: McGraw-Edison Company, Rolling Meadows, Ill.

[21] Appl. No.: 532,012

[22] Filed: Sep. 14, 1983

[51] Int. Cl.[3] ..... H01H 33/70

[52] U.S. Cl. ..... 200/148 A; 200/150 G

[58] Field of Search ..... 200/148 A, 150 G

[56] References Cited

U.S. PATENT DOCUMENTS

| | | | |
|---|---|---|---|
| 2,246,171 | 6/1941 | Grosse | 200/148 A |
| 4,160,888 | 7/1979 | Natsui et al. | 200/148 A |
| 4,219,711 | 8/1980 | McConnell | 200/148 A |
| 4,393,290 | 7/1983 | Mittelbach et al. | 200/148 A |
| 4,445,020 | 4/1984 | Ueda et al. | 200/148 A |

*Primary Examiner*—Robert S. Macon

*Attorney, Agent, or Firm*—Jon Carl Gealow; James A. Gabala; Hugh M. Gilroy

[57] ABSTRACT

A unique self-flow generating gas interrupter of the type wherein arc-extinction is performed by the creation of a negative pressure region brought about by the separation of the interrupter contacts. The interrupter incorporates a novel arrangement of valves so as to optimize the performance of the interrupter over the broad range of interrupting currents. In one embodiment a check valve is used to supply gas from the exterior of the interrupter casing and into the arcing chamber in response to the pressure within the arcing chamber decreasing or falling below a pre-selected value. In this manner, less force is required to operate the interrupter when low-currents are encountered. In another embdiment a relief valve is used to release the pressure developed in the arcing chamber in the event that a large interrupting current is encountered. Still another embodiment incorporates both the check valve and the relief valve.

14 Claims, 7 Drawing Figures

SELF-FLOW GENERATING GAS INTERRUPTER

TECHNICAL FIELD

This invention relates to circuit interrupters, in general, and, more particularly, to a circuit interrupter wherein arc-extinction is performed by the creation of a negative pressure region brought about by a separation of the interrupter contacts.

BACKGROUND OF THE INVENTION

The shortcomings of conventional puffer interrupters or gas circuit breakers (GCBs) has been the subject of continuous investigation. (e.g., IEEE paper 81 SM 413-4, *An Improvement of Low Current Interrupting Capability in Self Interruption GCB,* by Murari et al, submitted on Feb. 2, 1981). European Patent Application No. 0019806 (co-invented by two of the authors of the aforementioned IEEE paper) describes several embodiments of a circuit interrupter having an improved interrupting capability in the low current region. This interrupter uses a negative pressure zone formed by detaching operation of the contacts of the interrupter as a sort of "suction assist".

So-called negative pressure interrupters cause arc-interrupting gas flow by using: a piston, attached to a moving contact and located in a generally cylindrical chamber, to create a negative pressure zone, relative to the region across which the arc is formed when the interrupter is opened; and a nozzle of flow channel joining the two pressure zones. Thus, the separation of two interrupter contacts causes a pressure differential to be formed across the nozzle. This pressure differential will, in turn, cause a mass flow of interrupting gas, such as sulfur hexafloride ($SF_6$) which cools and extinguishes the arc at current-zero.

Conventional devices utilize a construction wherein the arc is formed within a closed volume, the arcing or upstream chamber relative to the flow nozzle. The flow nozzle is the only source of escape for the high pressure gas formed therein. If the temperature of the gas remains constant, as under low current conditions, then the pressure in the arcing chamber will decrease as gas is removed. Since the pressure within this chamber or zone decreases as the gas flows out of the flow nozzle, the mass and consequently the pressure of the gas in the adjacent negative pressure region increases. Therefore, it is necessary that the rate of change of volume in the negative pressure region increases with time in order to maintain a pressure differential. Mathematically, this relationship is expressed by:

$$V=LA$$

where V is the volume, L is the length of the negative pressure region or downstream chamber, and A is the cross sectional area of the chamber. For all practical purposes, in the case of cylindrical geometry, the cross sectional area, A, is a constant and the length of downstream chamber is a function of time. Thus, the rate of change of volume is:

$$dV/dt=AdL/dt=f(t)$$

In order for the rate of change of volume to increase with time, dL/dt must increase with time. The only way to gain an increasing dL/dt is to cause the piston to move at a greater rate of speed. This usually requires that the energy of the prime mover increase with time. In addition to being very costly, such an approach detracts from the advantages of gas circuit breakers utilizing the negative pressure principle to improve their operation in the low-current interrupting region. Since the prime mover of an interrupter represents a significant portion of the total cost of the device, a reduction of the required energy output from the prime mover will proportionately reduce the overall cost of the apparatus.

Another shortcoming of conventional self-flow generating interrupters utilizing a suction assist for improving low-current interruption operation, is the size of the arcing zone. The size of the arcing zone determines, for all practical purposes, the overall size of the interrupter. In other words, the size of the interrupter is determined, in large part, by the maximum current interruption capability of the device. Thus, the arcing zone is larger than what is needed for medium and smaller current interruption. More importantly, the performance of the interrupter in the mid and low interrupting current region is less than optimal.

It should be clear, therefore, that self-flow generating gas interrupters which utilize the negative pressure principle have heretofore been a compromise between what would be the optimal design of the interrupter over the entire range of currents that one would expect to flow through the device. Clearly, improvement is in order.

SUMMARY OF THE INVENTION

In accordance with the present invention, a self-flow generating gas interrupter is described having an improved low-current, mid-current and high-current interrupting capability. Specifically, the interrupter comprises: a casing filled with an arc-distinguishing gas; a pair of electrical contacts which are detachably carried within the casing so that one is free to move relative to the other between a closed and an open position; an arc-extinguishing gas storage chamber or arcing chamber which is defined by the contacts and the casing when the contacts are closed; a suction chamber defined by a piston which is operated in response to the opening of the contacts and the interrupter casing; a flow nozzle which separates the gas storage chamber from the suction chamber and through which the moving contact is stroked; a first valve means for supplying gas from the exterior of said casing to said chamber in response to the pressure within said chamber decreasing below a pre-selected first pressure value; and a second valve means for relieving the pressure in the chamber to the exterior of the casing in response to the pressure within the chamber increasing above a pre-selected second pressure value. Thus, when the interrupter is opened and when the current flow is low, the pressure in the arcing chamber decreases and the first valve means operates to supply gas to the arcing chamber. Effectively, the upstream pressure or the pressure within the arcing chamber is maintained relatively constant, and the rate of change of the volume of the downstream chamber or suction chamber does not have to increase as fast as would be required relative to an interrupter not provided with the first valve means. It is as if it had a larger upstream volume at low-current than at high-current interruption. More importantly, less energy is required of the prime mover operating the interrupter when a low-current is interrupted. If it is assumed that the volume of the arcing chamber is optimized for medium sized currents, then the second valve means functions to increase the volume of the arcing chamber in the event that a current in the high-current region is interrupted.

Thus, by proper selection of the arcing chamber volume and first and second valve settings, an interrupter can be optimized for maximum interruption capability across the entire range of operating currents. Numerous other advantages and features of the present invention will become apparent from the following detailed description of the invention and its various embodiments, from the claims, and from the accompanying drawings.

DETAILED DESCRIPTION OF THE INVENTION

Figure 1:
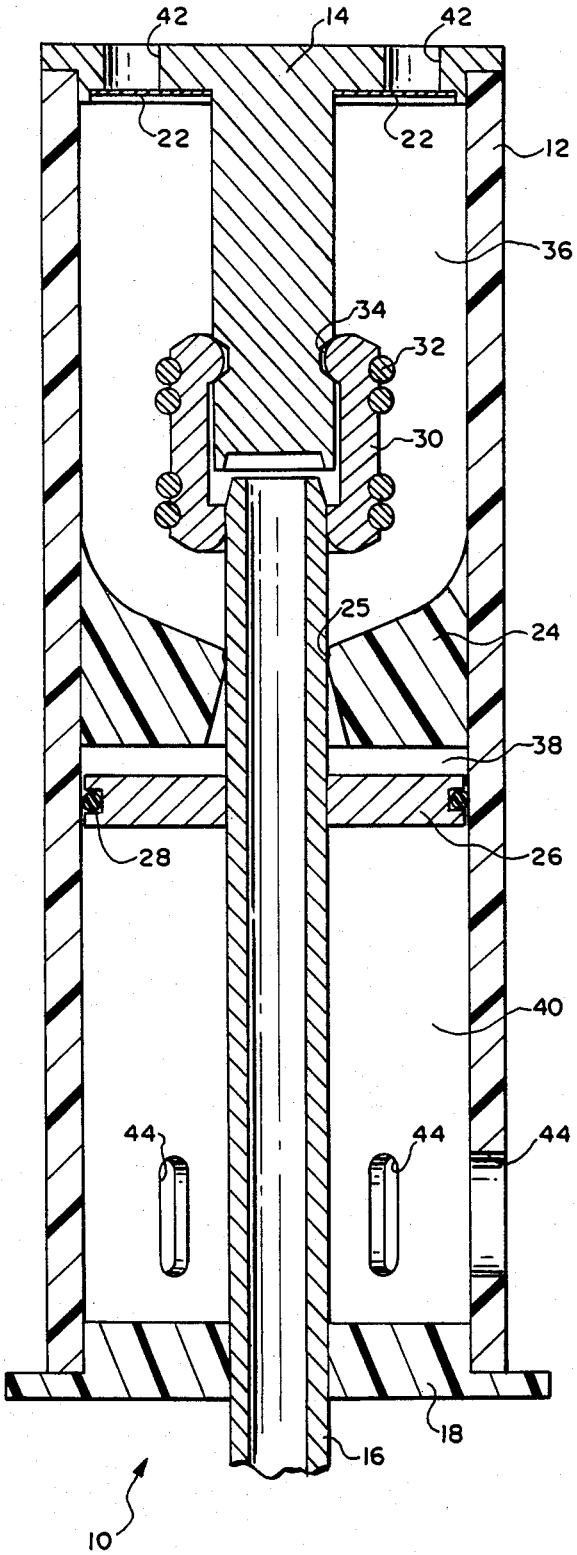
FIG. 1 has a cross-sectional, side, elevational view of the interrupter that is the subject of the present invention, with the interrupter in its closed position.

While the invention is acceptable of embodiment in many different forms, there is shown in the drawings and will herein be described in detail several preferred embodiments of the invention. It should be understood, however, that the present disclosure is to be considered an exemplification of the principles of the invention and that it is not intended to limit the invention to the specific embodiments illustrated. To better explain the unique aspects of the invention, the major components of the invention will first be described and then the integrated operation will be related.

MAJOR COMPONENTS

Refering to the drawings, and to FIG. 1 in particular, a cross-sectional view is presented of the interrupter 10 that is the subject of the present invention. The interrupter 10 includes: a generally cylindrical, stationery interior tank or casing 12, perferably formed from an insulating material, and adapted to be filled with an arc-extinguishing gas such as $SF_6$; a fixed electrical contact structure 14 at one end of the tank 12; an oppositely disposed hollow contact 16 which is adapted to be moved towards and away from the fixed contact in response to the operation of the prime mover (not shown for purposes of clarity); a guide 18 for the moving contact; a piston 26 which is carried by and moves in response to the moving contact; and a flow guide 24. The fixed electrical contact structure 14 defines a plurality of flow channels 42 which are plugged by a set of check valves 22, the purposes of which will be explained shortly. The walls of the tank 12, at the lower end, define a plurality of generally longitudinal slots or apertures 44, the purposes of which will be explained in due course. Finally, it should be noted that the flow guide 24 defines a central aperture or throat 25 through which the moving contact 16 passes in moving towards and away from the fixed electrical contact 14.

Turning to the upper end of the tank 12, the fixed contact 14 carries a plurality of contact fingers 30 which are radially disposed about the free end of fixed contact. These fingers 30 are held in place by plurality of garder springs 32. One end of each finger 30 is carried within an annular channel or slot 34 adjacent the free end of the fixed contact 14. Thus, when the movable contact 16 moves towards and away from the free end of the fixed contact 14, the free end of the contact fingers 30 are drawn about the periphery of the free end of the moving contact 16. This insures a good electrical connection across the two electrical contacts 14 and 16 when the interrupter is closed. When the interrupter 10 is closed, the upper end of the interior of the tank 12, and the flow nozzle 24 defines a closed chamber 36. This chamber 36 will hereinafter be referred to as the "arcing chamber". The check valves 22 are normally closed and arranged to open inwardly towards the arcing chamber 36 when a differential pressure is developed across them. These check valves 22 in one embodiment, are designed to open at a relatively low pressure differential (i.e., 0.5 to 1.0 PSI).

Turning now to the lower end of the interrupter 10, two chambers are defined by the tank 12, the piston 26, the moving contact 16 and the flow nozzle 24, on one hand, and the tank, the piston, the moving contact and the contact guide 18, on the other hand. The chamber 38 defined by the upper end of the piston 26, the interior walls of the tank 12, and the lower end of the flow nozzle 24 will hereinafter be referred to as "suction chamber". The chamber 40 defined by the lower end of the piston 26, the interior walls of the tank 12, the moving contact 16, and the contact guide 18 will hereinafter be referred to as the "damping chamber". The piston 26 carries a sealing means, such as a O-ring or piston ring, to form a seal between the suction chamber 38 and the damping chamber 40.

OPERATION

Now that the major components of one embodiment of the invention have been described, its unusual and characteristics operation will be explained in detail. Turning to FIG. 1, the interrupter 10 is opened by withdrawing or separating the moving contact 16 from the fixed contact 14. Since the piston 26 is carried by the moving contact 16, the downward movement of the moving contact will increase the interior volume of the suction chamber 38 and decrease the volume of the damping chamber 40. The relatively close proximity between the exterior of the upper end of the moving contact 16 and the aperture 25 defined by the flow nozzle 24 give rise to a differential pressure being developed between the suction chamber 38 and the arcing chamber 36. When the free end of the moving contact 16 separates from the contact fingers 30 an electrical arc is formed. Thus, the gas in the arcing chamber 36 is heated which in turn causes a pressure increase.

Figure 2:
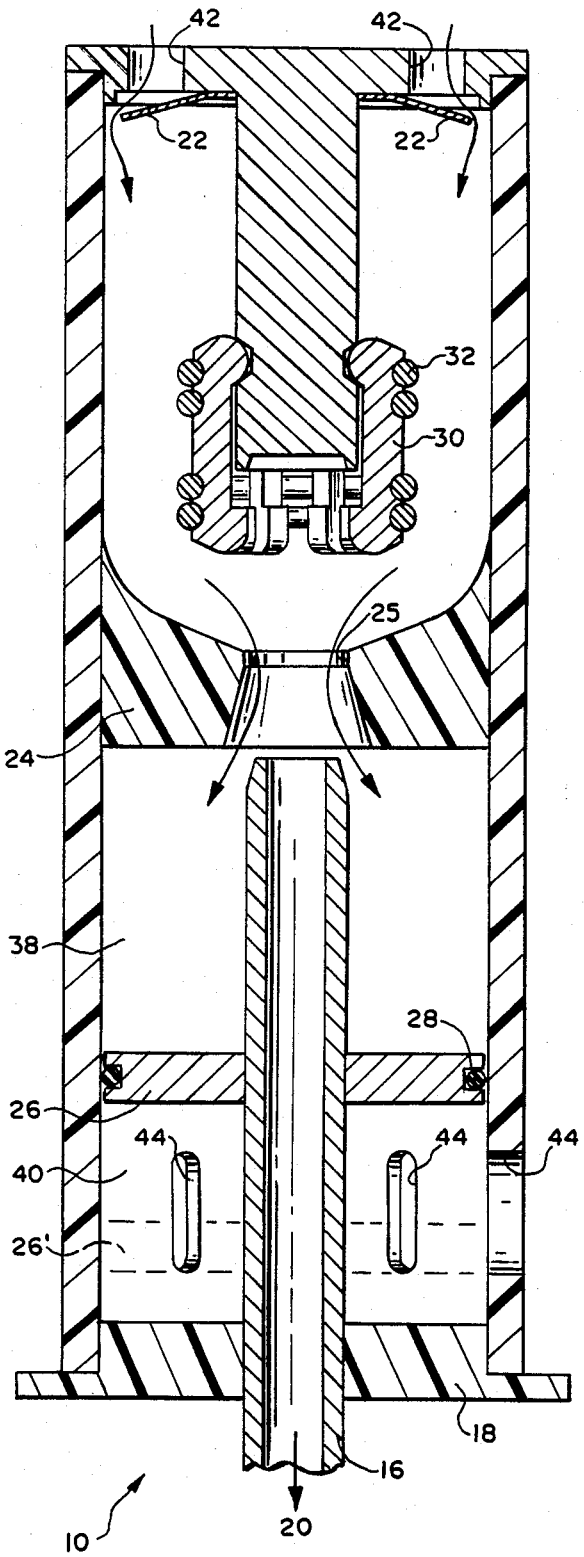
FIG. 2 is the interrupter shown in FIG. 1, immediately following arc-extinguishment after interrupting a relatively low-current.

Turning now to FIG. 2, when the upper end of the moving contact 16 passes clear of the throat 25 of the flow nozzle 24, the gas in the arcing chamber 36 is forced to flow through the nozzle and into the suction chamber 38. In this matter the electrical arc is cooled and eventually extinguished. Eventually, the piston 26 will be driven across the flow shots 44 at the lower end of the tank 12. When this happens the gas in the damping chamber 40 will be compressed effectively restricting further downward movement of the moving contact 16. In this matter the downward acceleration of the moving contact 16 is reduced and sudden shocks are avoided.

Turning now to the upper end of the arcing chamber 36, it should be appreciated that by properly sizing the arcing chamber 36 and the suction chamber 38, there is a certain range of currents, which when interrupted will result in the pressure in each chamber being less than the pressure of the gas on the outside of the tank 12. In other words, the differential pressure will develop across of the upper end of the tank 12. This forces the check valves 22 open allowing gas to flow from the exterior of the tank in to its upper interior. This effectively maintains the pressure upstream of the flow nozzle 24 or the pressure in the arcing chamber 36 essentially equal to the pressure of the surrounding ambient (i.e., the exterior of the tank). Since the upstream pressure is constant, the rate of change of volume of the downstream chamber (i.e., the suction chamber 38) does not have to increase as fast as would be required in an interrupter 10 without the check valves 22 installed. As was previously explained, this condition allows a lower energy input by the prime mover in operating the interrupter 10.

Figure 3:
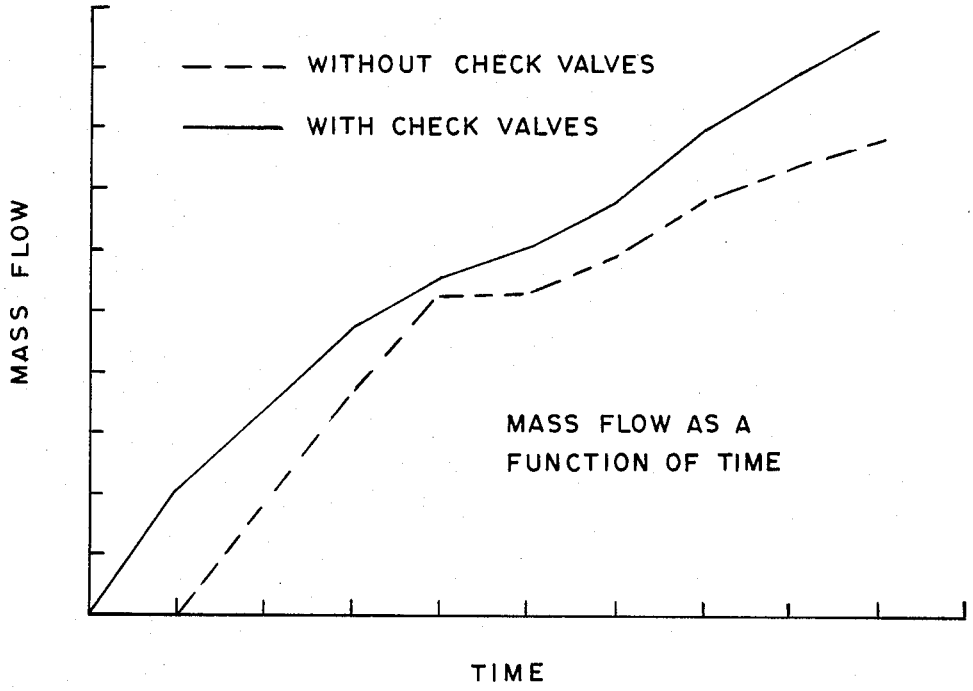
FIG. 3 is a graph illustrating mass flow as a function of time.
Figure 4:
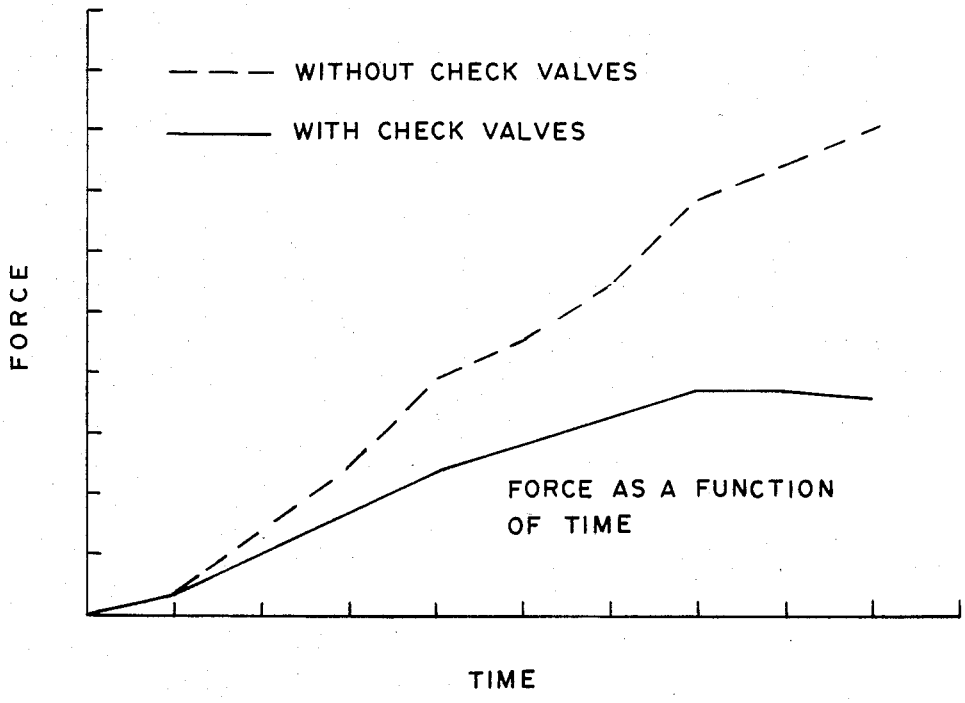
FIG. 4 is a graph of force as a function of time.
Figure 6:
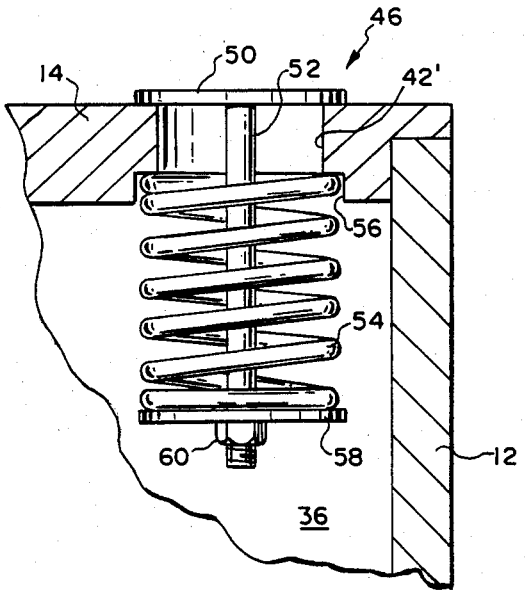
FIG. 6 is an enlarged, partial, cross-sectional view of the upper left-hand portion of the interrupter shown in FIG. 5.

Turning to FIG. 3 and 4, two plots are shown which show values of mass flow and input force for an interrupter with and without check valves. These calculations were made using identical values of $dL/dt=f(t)$ for calculating the position of the piston 26. These graphs dramatically show that the interrupter having the check valves has a greater mass flow through the nozzle 24 joining the arcing chamber 36 and the suction chamber 38. More importantly, it shows a reduction in the input force required to move the piston 26 in operating the interrupter. Those skilled in the art know that the prime mover or mechanism which operates a distribution class switchgear represents a significant part of the total cost of the device. Therefore, a reduction in the required energy output of the mechanism will proportionately reduce the cost of the device. Those skilled in the art will also understand that by use of the check valves, the interrupter 10 operates as if it had a larger upstream volume (i.e., the volume in the arcing chamber 36) at low currents than at high currents. If the size of the arcing chamber 36 and the suction chamber 38 is designed for interrupting a relatively medium sized electrical current, then when a high current is interrupted, a significantly large pressure increase (5 to 100 PSI) will be developed in the arcing chamber relative to the pressure of the surrounding ambient on the outside of the tank 12. In this case, the check valves 22 will remain shut, thereby preventing the flow of gas from the arcing chamber directly to the ambient. Here, all of the gas flow will be through the gas flow nozzle 24.

There is one disadvantage of this embodiment, effectively the arcing chamber 36 must be sized to absorb the arc energy resulting from the maximum current interruption anticipated without over pressurizing the tank 12. Thus, to prevent an over-pressure condition, the volume of the arcing chamber 36 would have to be larger than what is needed for medium current interruption. Therefore, it is possible that such a design would detract from the performance of the device when it is operated in the mid interrupting current range.

Figure 7:
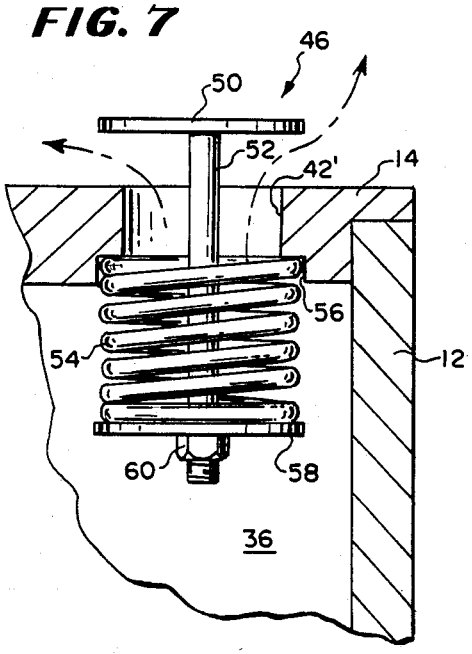
FIG. 7 is a view, similar to that of FIG. 6, with the valve shown there in its opened position.
Figure 5:
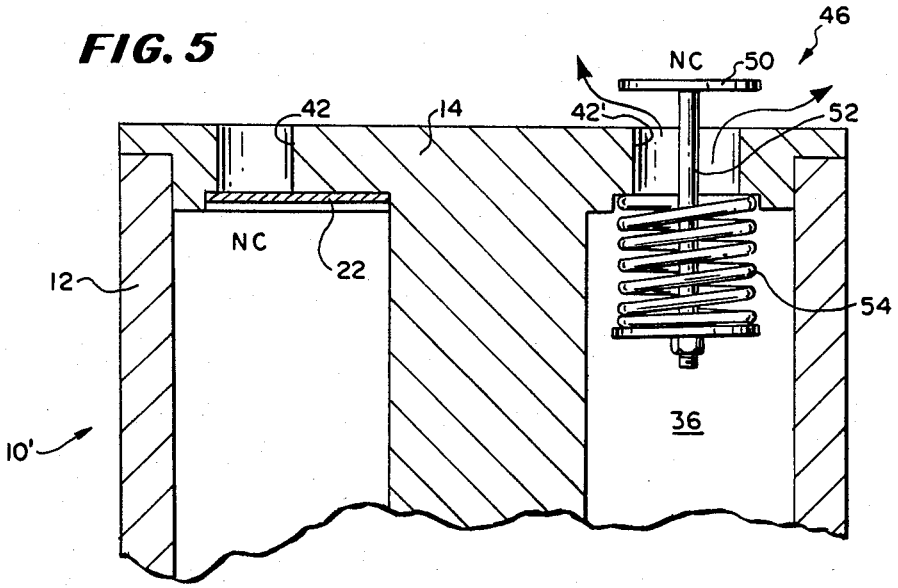
FIG. 5 is enlarged, partial, cross-sectional view of another embodiment of the interrupter shown in FIG. 1.

FIG. 5 is the second embodiment of the invention. The interrupter 10' shown there includes a pressure relief 46 at the upper end of the arcing chamber 36. The pressue relief 46 is a valve designed to release the pressure at the interior of the arcing chamber 36 to the surrounding ambient (i.e. the outside of the tank 12). In the embodiment illustrated, the pressure relief 46 is a poppet valve. It includes a disk 50, a stem 52 and a spring 54. When the valve is closed the disc 50 plugs an opening 42' which joins the arcing chamber 36 with the surrounding ambient. The spring 54 is biased between a seat 56 at the interior of the arcing chamber 36 and a plate 58 carried at the other end of the stem 52. In this particular case the plate 58 is held in position relative to the end of the stem 52 by a threaded fitting 60. Thus, the compressive force between the plate 58 and the seat 56 may be adjusted. The compression of the spring 54 determines the pressure-force which must be developed at the interior of the arcing chamber 36 to overcome the force of the spring 54. Once the pressure-force applied to the disc 50 is sufficiently great, the relief valve 46 will pop open (see FIG. 7), thereby relieving the pressure at the interior of the arcing chamber 36. The relief valve 46 should be adjusted to maintain the pressure below some maximum value (i.e., 100 to 200 PSI over ambient). Thus, by incorporating a pressure relief 46 for the arcing chamber 36, the interior volume can be sized for maximum efficiency in the mid-interrupting current range while at the same time preventing over-pressurization of the tank 12 in the event that a current in the maximum current interrupting range is encountered.

From the foregoing, it will be observed that numerous variations and modifications may be effected without departing from the spirit and scope of the novel concept of the invention. For example, an interrupter design incorporating both check valves 22 and relief valves 46 having an arcing chamber 36 optimized for performance in the mid-interrupting current range, can be efficiently operated to encounter current in both in the maximum and minimum current interrupting ranges. Thus, an interrupter can be designed for efficient interruption capability across a wide range of currents while requiring a prime mover which needs only be designed to interrupt currents in the mid range. This is truly a surprising result. It should be understood however, that no limitation with respect to the specific apparatus illustrated herein is included or should be inferred. It is, of course, intended to cover by the appended claims all such modifications as fall within the scope of the claims.

I claim:

1. A circuit interrupter comprising:

(a) a stationary casing adapted to be filled with an arc extinguishing gas;

(b) a first electrical contact carried by said stationery casing;

(c) a second electrical contact which is movably disposed within and carried by said stationery casing so as to engage and disengage said first contact;

(d) negative pressure means, comprising a suction chamber formed by a cylinder and a piston, for producing a negative pressure region within said cylinder in response to disengaging movement of said first and second contacts, one of said piston and cylinder being carried by said second electrical contact;

(e) a gas storage chamber formed by said stationary casing and said first and second contacts when said first and second contacts are engaged;

(f) a suction guide for connecting said storage chamber to said negative pressure region within said negative pressure means; and (g) first valve means, in flow communication with said gas storage chamber, for supplying gas from said casing to said chamber in response to pressure within said chamber decreasing below a pre-selected first pressure value.

2. The circuit interrupter according to claim 1, wherein one end of said stationary casing forms the cylinder of said negative pressure means.

3. The circuit interrupter according to claim 1, wherein said second contact is connected to said piston.

4. The circuit interrupter according to claim 1, further including second valve means, in flow communication with said gas storage chamber, for relieving the pressure from said chamber to the exterior of said casing in response to the pressure within said chamber increasing above a pre-selected second pressure value.

5. A circuit interrupter, comprising:

(a) a stationery tank adapted to be filled with an arc-extinguishing fluid;

(b) a pair of electrical contacts which are detachably carried within said stationery tank;

(c) an arc extinction gas storage chamber at one end of said tank which is defined by said contacts and said tank in the closing of said contacts;

(d) a suction chamber which is formed by one of said contacts and a piston disposed within the other end of said tank, said one contact and said piston being adapted to move together in the event said contacts are detachably operated so as to increase the volume therein; and (e) relief valve means at said one end of said tank for relieving pressure in said storage chamber in response to the pressure within said storage chamber increasing above a pre-selected second pressure value.

6. The circuit interrupter according to claim 5, further including:

check valve means, at said one end of said tank, for releasing fluid from the exterior of said tank and into said gas storage chamber in response to the pressure in said gas storage chamber decreasing below a pre-selected first pressure value; and a guide, carried by said tank, for connecting said suction chamber to said storage chamber through a flow channel for arcing between said contacts.

7. The circuit interrupter according to claim 5, wherein the other of said pair of contacts is fixed to said stationary tank.

8. The circuit interrupter according to claim 5, wherein said piston is carried by said one contact so as to move in response thereto.

9. The circuit interrupter according to claim 5, wherein said tank is made of an insulating material.

10. The circuit interrupter according to claim 6, wherein said guide is formed by an insulating nozzle having an opening for passing said one contact there through.

11. The circuit interrupter according to claim 10, wherein said guide is configured in the shape of a flow nozzle.

12. The circuit interrupter according to claim 5, wherein said piston and tank define a damping chamber at the other end of said tank, said piston separating said damping chamber from said suction chamber, whereby said damping chamber decreases in volume while said suction chamber increases in volume in response to the detaching operation of said one contact.

13. The circuit interrupter according to claim 12, wherein said tank defines a slotted opening in communication with said damping chamber during a substantial portion of the detaching operation of said one contact.

14. A circuit interrupter, comprising:

(a) a generally cylindrical stationery tank adapted to be filled and immersed within with an arc-extinguishing fluid;

(b) a pair of electrical contacts which are detachably carried within said tank, said one contacts being free to move towards and away from the other contact in response to the operation of a prime mover, said one contact being free to move between a closed position wherein said contacts are abutting and a opened position wherein said contacts are separated;

(c) an arc extinction gas storage chamber at one end of said tank which is defined by said tank and said contacts when said contacts are abutting on another;

(d) a suction chamber which is defined by said tank, said one contact and a piston disposed between said tank and said one contact and connected to said one contact so as to move in response to the movement of said one contact, the volume of said suction chamber increasing in the event that said contacts are separated;

(e) an insulating guide defined by said said tank, for connecting said suction chamber to said storage chamber;

(f) a check valve, carried by said tank for release fluid from the exterior of said tank and into said gas storage chamber in response to the pressure to said gas storage chamber decreasing below a pre-selected first pressure value;

(g) a relief valve, carried by said tank, for relieving the pressure in said storage chamber in response to the pressure within said storage chamber increasing above a pre-selected second pressure value; and (h) a damping chamber, at the other end of said tank, defined by said piston and said one contact, said tank defining a flow aperture in flow communication with said damping chamber when said contacts are abutting one another and in flow communication with said suction chamber when said one contact is intermediate its closed position and its opened position.

* * * * *